US008296977B2

(12) United States Patent
Lee

(10) Patent No.: US 8,296,977 B2
(45) Date of Patent: Oct. 30, 2012

(54) EMERGENCY-LIGHT INDICATOR

(76) Inventor: Sung-Keun Lee, Huizhou (CN)

( * ) Notice: Subject to any disclaimer, the term of this patent is extended or adjusted under 35 U.S.C. 154(b) by 0 days.

(21) Appl. No.: 13/096,185

(22) Filed: Apr. 28, 2011

(65) Prior Publication Data

US 2012/0174448 A1 Jul. 12, 2012

(30) Foreign Application Priority Data

Jan. 7, 2011 (CN) ..... 2011 2 0012900 U

(51) Int. Cl.
*G09F 13/04* (2006.01)

(52) U.S. Cl. ..... 40/570; 40/564

(58) Field of Classification Search ..... 40/564, 40/570; 362/812
See application file for complete search history.

(56) References Cited

U.S. PATENT DOCUMENTS

| | | | | |
|---|---|---|---|---|
| 6,142,648 | A * | 11/2000 | Logan et al. | 362/234 |
| 6,457,270 | B1 * | 10/2002 | Stark et al. | 40/570 |
| 7,845,103 | B2 * | 12/2010 | Logan et al. | 40/570 |
| 2006/0215403 | A1 * | 9/2006 | Martineau | 362/240 |
| 2006/0225328 | A1 * | 10/2006 | Hasan | 40/570 |

* cited by examiner

*Primary Examiner* — Casandra Davis

(57) ABSTRACT

An emergency-light indicator includes an emergency light module and an indication light module includes a front cover module, a frame, a PCB module configured in the frame, multiple battery modules configured in the frame and a back panel module. A latching groove is configured on top and bottom of the frame. An emergency sign is displayed on either or both the front cover module and the back panel module. The emergency light module includes multiple LED modules and a bracket set. Each of the LED modules is structured by a lens, a reflect-light ring, a first spring, a second spring, a LED PCB, a right cover and a left cover. Multiple latching blocks are configured on the bracket set. The latching blocks are corresponding to the latching groove. The emergency light module is installed to the indication light module via a latch of the latching blocks and the latching groove.

6 Claims, 5 Drawing Sheets

EMERGENCY-LIGHT INDICATOR

FIELD OF THE INVENTION

The present invention generally relates to an emergency-light indicator, and more particularly to an emergency-light indicator having an assembly of an indication light module and an emergency light module.

BACKGROUND OF THE INVENTION

In a conventional emergency-light indicator structure, the indication light module and the emergency light module is a one-piece structure, which means both are fixedly installed to each other and are not detachable. Therefore, the conventional emergency-light indicator may need more packaging consumables so as more transportation cost. In addition, users may feel inconvenient to use the emergency-light indicator due to the exit indication light and the emergency light modules are not detachable.

SUMMARY OF THE INVENTION

Therefore, an objective of the present invention is to provide an emergency-light indicator having an assembly of an indication light module and an emergency light module. Because the indication light module and the emergency light module are detachable to each other, thereby the disadvantages in the conventional emergency-light indicator are overcome.

The present invention provides an emergency-light indicator structured by an indication light module and an emergency light module. The indication light module comprises a front cover module, a PCB (Printed Circuit Board) module, a frame, a plurality of battery modules and a back panel module. The front cover module and the back panel module are respectively configured in front and back of the frame. The PCB module and the battery modules are configured in the frame. A latching groove module is configured on top and bottom of the frame. An emergency sign is displayed on either or both the front cover module and the back panel module. The emergency light module comprises a plurality of LED (Light Emitting Diode) modules and a bracket set. Each of the LED modules is structured by a lens, a reflect-light ring, a first spring, a second spring, a LED PCB, a right cover and a left cover. A plurality of first latching blocks are configured on the bracket set. The first latching blocks are corresponding to the latching groove module, thereby the emergency light module can be installed to the indication light module via a latch of the first latching blocks and the latching groove module.

In one embodiment, the above mentioned emergency-light indicator further comprises a top plate with a plurality of second latching blocks. The second latching blocks are corresponding to the latching groove module, thereby the top plate can be installed to the indication light module via a latch of the second latching blocks and the latching groove module.

In one embodiment, the above mentioned first latching blocks, the second latching blocks and the latching groove module have a right-angle shape.

In one embodiment, the above mentioned emergency light module can be packed inside the indication light module.

In one embodiment, the above mentioned frame further comprises a first connector and the above mentioned bracket set further comprises a second connector. The LED modules can be electrically connected to the PCB module and the battery module through an electrical connection of the first and second connectors.

In one embodiment, the above mentioned LED modules have a ball shape thereby each of the LED modules has a full-angle modulation manner.

In summary, the emergency-light indicator of the present invention primarily is structured by the indication light module and the emergency light module. Due to the structure of the emergency-light indicator of the present invention, the emergency-light indicator of the present invention has advantages of: easily to detach the emergency light module and the indication light module from each, a relatively small packaging size, less packaging consumables and less transportation cost.

BRIEF DESCRIPTION OF THE DRAWINGS

The above objects and advantages of the present invention will become more readily apparent to those ordinarily skilled in the art after reviewing the following detailed description and accompanying drawing, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

To get a clear understanding of the present invention, the following description of the present invention will be given combined with diagrams.

Figure 1A:
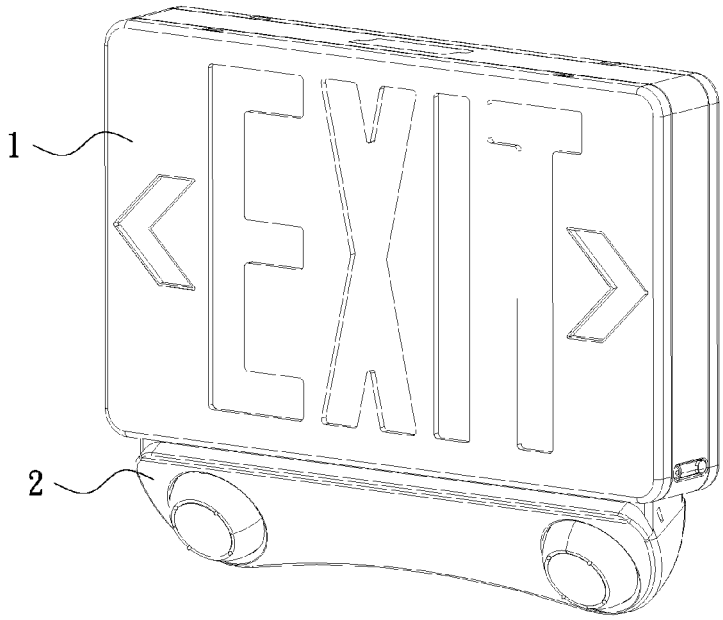
FIGS. 1A and 1B are schematic diagrams of an overall structure of an emergency-light indicator (wall-type) in accordance with one embodiment of the present invention.
Figure 1B:
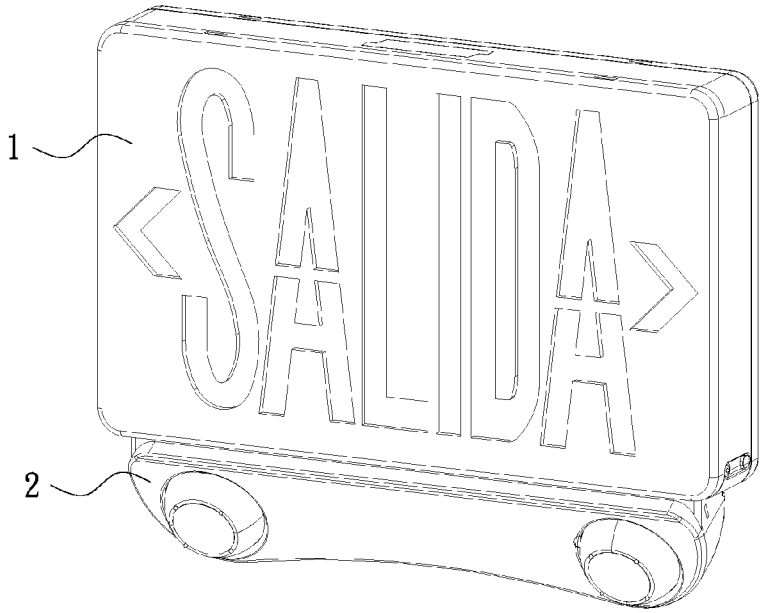

FIGS. 1A and 1B are schematic diagrams of an overall structure of an emergency-light indicator in accordance with one embodiment of the present invention. As depicted in FIGS. 1A and 1B, the emergency-light indicator is primarily structured by an indication light module 1 and an emergency light module 2 which is configured (i.e., structured and arranged) on the bottom of the indication light module 1. The indication light module 1 is used for displaying specific information; for example, an "EXIT" sign is displayed on the indication light module 1 in FIG. 1 and a "SALIDA" sign is displayed on the indication light module 1 in FIG. 2. The emergency light module 2 is used for providing emergency light. Herein, an emergency light indicator specifically designed for being set on a wall is referred to a wall-type emergency light indicator, as depicted in FIGS. 1A and 1B.

Figure 2:
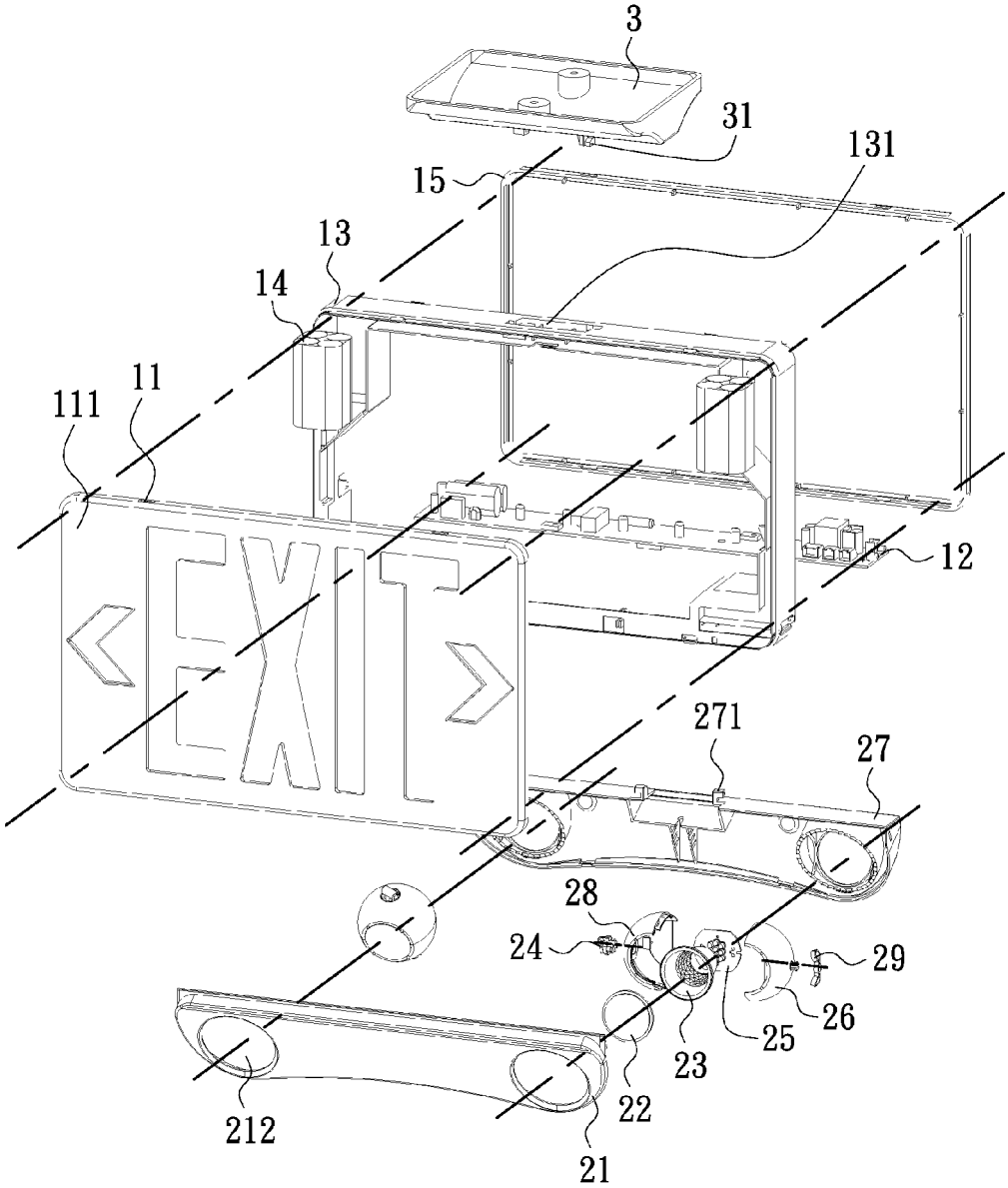
FIG. 2 is a schematic exploded diagram of the emergency-light indicator depicted in FIG. 1.

FIG. 2 is a schematic exploded diagram of the emergency-light indicator as depicted in FIGS. 1A and 1B. The indication light module 1 primarily comprises a front cover module 11, a PCB (Printed Circuit Board) module 12, a frame 13, a plurality of battery modules 14 and a back panel module 15. The front cover module 11 is configured in front of the frame 13 and an emergency indication sign 111 is displayed on thereof. The back panel module 15 is configured in back of the frame 13; it is noticed that the emergency indication sign 111 may also be displayed on the back panel module 15 if necessary. The PCB module 12 and the battery modules 14 are configured in the frame 13. A latching groove module 131 with a right-angle shape is configured on both the top and bottom sides of the frame 13.

Still referring to FIG. 2, the emergency light module 2 primarily comprises a bracket set and two LED (Light Emitting Diode) modules. The bracket set is primarily structured by a bracket panel 21 and a main bracket 27. Via a latch of the bracket panel 21 and the main bracket 27, the aforementioned bracket set is structured. Each of the LED modules is primarily structured by a lens 22, a reflect-light ring 23, a first spring 24, a second spring 29, a LED PCB 25, a right cover 26 and a left cover 28. The lens 22 is configured in front of the reflect-light ring 23. The LED PCB 25 is configured in the back of the reflect-light ring 23. The right cover 26 and the left cover 28 can be latched together, and via a latch of the right cover 26 and the left cover 28 with the lens 22, the reflect-light ring 23 and the LED PCB 25 inside the aforementioned LED module is structured. The LED module is installed to the bracket set via the first spring 24 and the second spring 29. Both the bracket panel 21 and the main bracket 27 have two holes 212, for installing the two LED modules, respectively configured at each end thereof, thereby via a latch of the bracket panel 21 and the main bracket 27 with the LED modules inside, the emergency light module 2 is structured. As depicted in FIG. 2, because the two LED modules have a ball shape and are structured together with the bracket set via the first spring 24 and the second spring 29, both the LED modules have a full-angle modulation manner.

Two first latching blocks 271 with a right-angle shape are configured on the top of the main bracket 27. Specifically, the first latching blocks 271 are corresponding to the latching groove module 131. In other words, via the first latching blocks 271 and the latching groove module 131, the emergency light module 2 can be latched to or unlatched from the indication light module 1, thereby users can choose to use the emergency light module 2 and the indication light module 1 separately or use them together.

Figure 3:
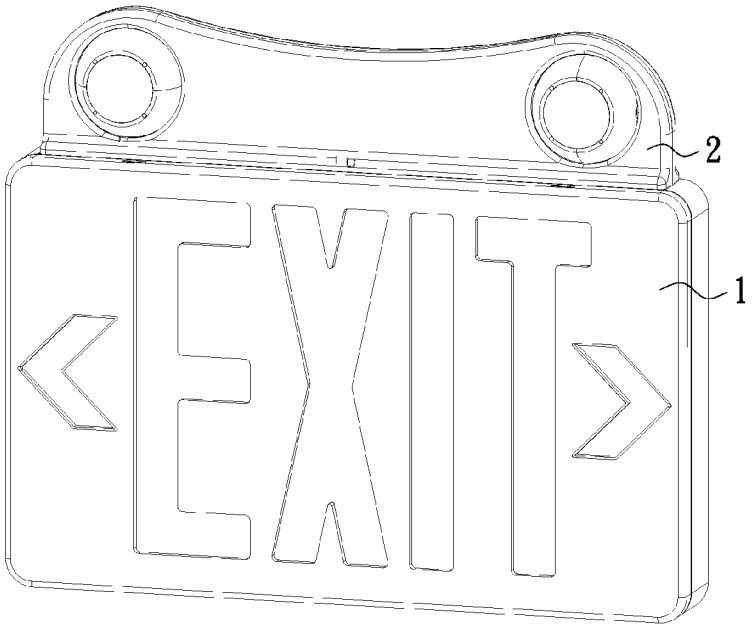
FIG. 3 is a schematic diagram of an overall structure of an emergency-light indicator in accordance with another embodiment of the present invention.

It is noticed that the emergency light module 2 is not restrict to be configured on the bottom of the indication light module 1. FIG. 3 is a schematic diagram of an overall structure of an emergency-light indicator in accordance with another embodiment of the present invention. Via a latch of the first latching blocks 271 and the latching groove module 131 on the top of the frame 13, the emergency light module 2 can be configured on the top of the indication light module 1 as depicted in FIG. 3.

Figure 4:
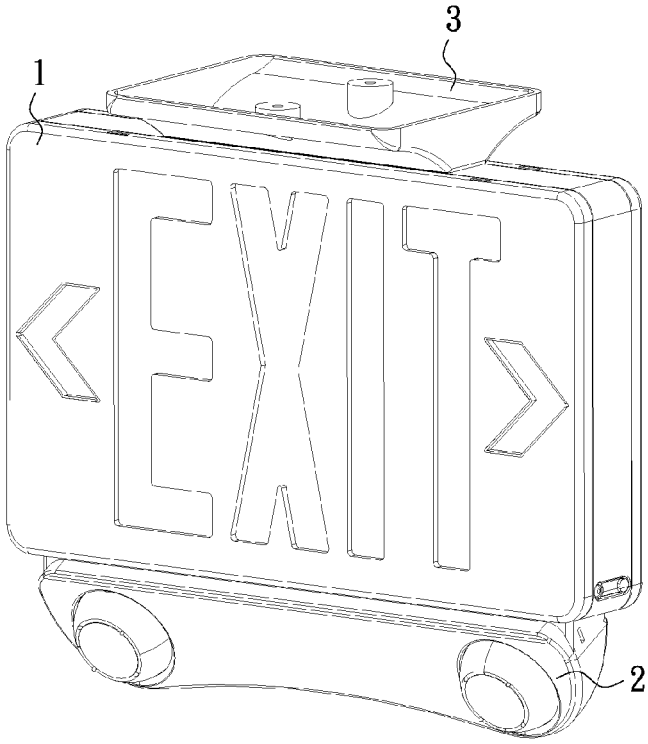
FIG. 4 is a schematic diagram of an overall structure of an emergency-light indicator (ceiling-type) in accordance with another embodiment of the present invention.
Figure 5:
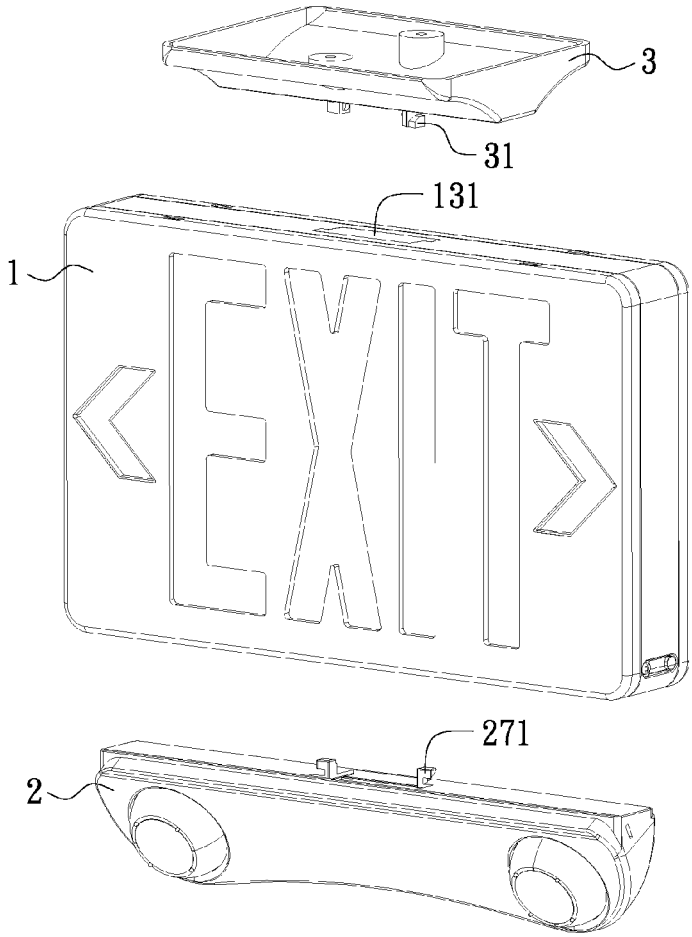
FIG. 5 is a schematic assembling diagram of the ceiling-type emergency light indicator depicted in FIG. 4.

In addition, it is noticed that the emergency light indicator of the present invention is not restrict to be configured on a wall. FIG. 4 is a schematic diagram of an overall structure of an emergency-light indicator in accordance with another embodiment of the present invention. As depicted in FIG. 4, through a top plate 3, the emergency light indicator can be configured on a ceiling. Herein, an emergency light indicator specifically designed for being set on a ceiling is referred to a ceiling-type emergency light indicator. FIG. 5 is a schematic assembling diagram of the ceiling-type emergency light indicator depicted in FIG. 4. The top plate 3 comprises two second latching blocks 31 with a right-angle shape on its bottom and the second latching blocks 31 are corresponding to the latching groove module 131. Via a latch of the second latching blocks 31 and the latching groove module 131, the indication light module 1 is latched to the top plate 3.

Figure 6:
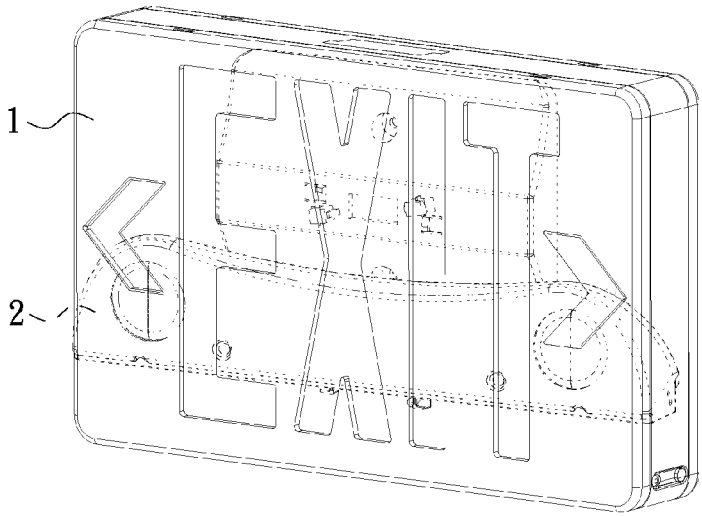
FIG. 6 is a schematic diagram that exemplarily illustrates the emergency light module is packed inside the indication light module.
Figure 7:
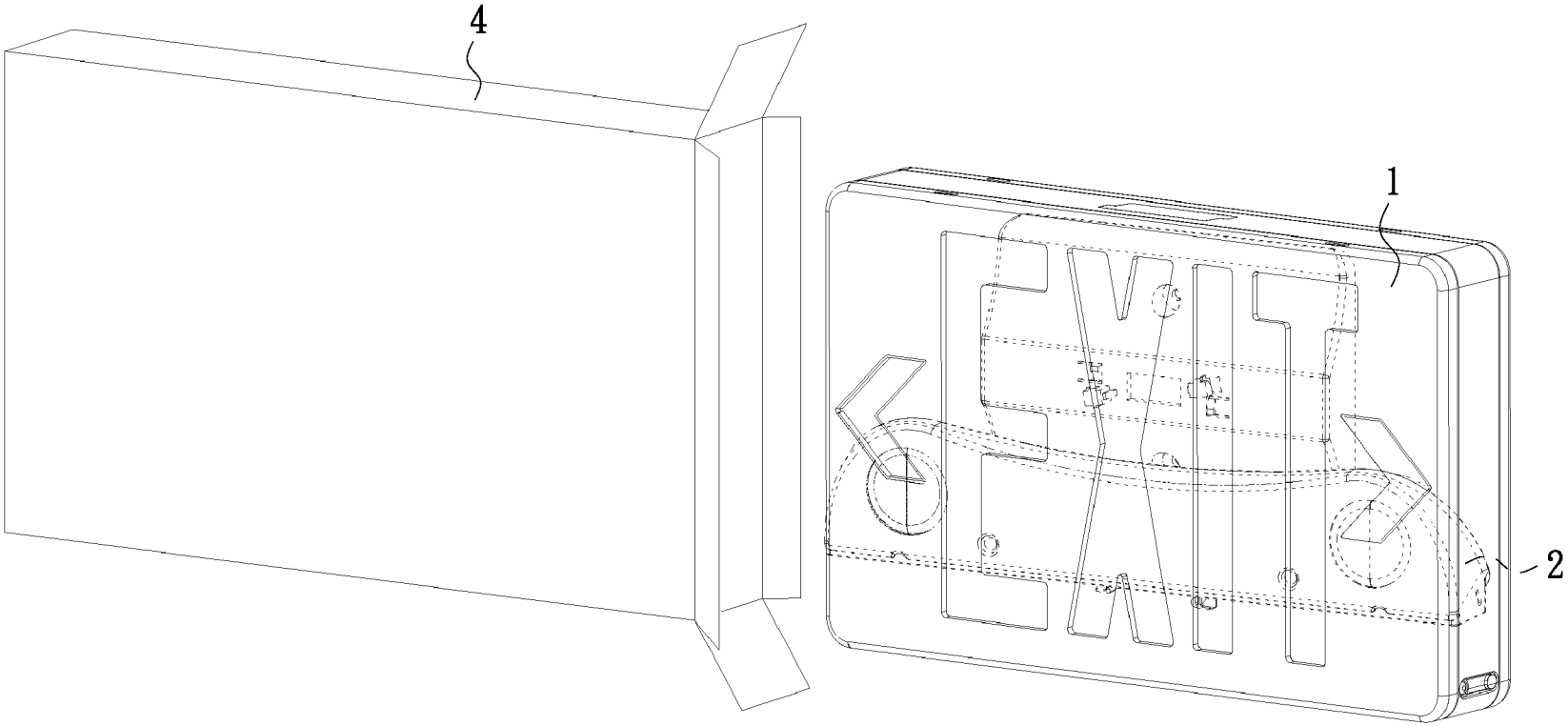
FIG. 7 is a schematic diagram that exemplarily illustrates the process of packing the emergency-light indicator in a box.

In the embodiments of the present invention, the emergency light module 2 has a smaller size than the indication light module 1 has, thereby the emergency light module 2 can be packed inside the indication light module 1 as depicted in FIG. 6. FIG. 7 is a schematic diagram that exemplarily illustrates the process of packing the emergency-light indicator in a box. As depicted in FIG. 7, the emergency light module 2 is firstly packed in the indication light module 1, and the indication light module 1 is then packed in a box 4. Because the emergency light module 2 is capable to be packed inside the indication light module 1, thereby the packaging consumables and the transportation cost are accordingly reduced.

Moreover, the frame 13 of the indication light module 1 may further comprise a first connector (not shown) which is electrically connected to the PCB module 12 and the battery modules 14. The bracket set of the emergency light module 2 may further comprise a second connector (not shown) which is electrically connected to the two LED modules. Via an electrical connection between the first and second connectors, the two LED modules can be controlled and powered by the PCB module 12 and the battery modules 14.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An emergency-light indicator, comprising:

an indication light module, comprising a front cover module, a printed circuit board module, a frame, a plurality of battery modules and a back panel module, wherein the front cover module and the back panel module are respectively configured in front and back of the frame, the printed circuit board module and the battery modules are configured in the frame, a latching groove module is configured on both the top and bottom of the frame, an emergency sign is displayed on either or both the front cover module and the back panel module; and an emergency light module, comprising a plurality of light emitting diode modules and a bracket set, wherein each of the light emitting diode modules is structured by a lens, a reflect-light ring, a first spring, a second spring, a light-emitting-diode printed circuit board, a right cover and a left cover, a plurality of first latching blocks are configured on the bracket set;

wherein the first latching blocks are corresponding to the latching groove module, thereby the emergency light module can be installed to the indication light module via a latch of the first latching blocks and the latching groove module.

2. The emergency-light indicator according to claim 1, further comprising:

a top plate, comprising a plurality of second latching blocks, wherein the second latching blocks are corresponding to the latching groove module, thereby the top plate can be installed to the indication light module via a latch of the second latching blocks and the latching groove module.

3. The emergency-light indicator according to claim 2, wherein the first latching blocks, the second latching blocks and the latching groove module have a right-angle shape.

4. The emergency-light indicator according to claim 1, wherein the emergency light module can be packed inside the indication light module.

5. The emergency-light indicator according to claim 1, wherein the frame further comprises a first connector and the bracket set further comprises a second connector, thereby the light emitting diode modules can be electrically connected to the printed circuit board module and the battery module via an electrical connection of the first and second connectors.

6. The emergency-light indicator according to claim 1, wherein the light emitting diode modules have a ball shape thereby each of the light emitting diode modules has a full-angle modulation manner.

* * * * *